US007421797B1

(12) United States Patent
Servin et al.

(10) Patent No.: US 7,421,797 B1
(45) Date of Patent: Sep. 9, 2008

(54) CABINET PARTITION POSITIONER

(75) Inventors: Juvenal Servin, Santa Ana, CA (US); Brian Taber, 2001 Costero Hermoso, San Clemente, CA (US) 92673-3655

(73) Assignees: Peter Minegar, Temecula, CA (US); Brian Taber, Temecula, CA (US)

( * ) Notice: Subject to any disclaimer, the term of this patent is extended or adjusted under 35 U.S.C. 154(b) by 0 days.

(21) Appl. No.: 11/985,520

(22) Filed: Nov. 15, 2007

(51) Int. Cl.
*G01D 21/00* (2006.01)

(52) U.S. Cl. ..... 33/613; 33/520; 33/533

(58) Field of Classification Search ..... 33/613, 33/562, 520, 533, 644, 666–667, 676–678, 33/549, 558.01, 558.02, 197
See application file for complete search history.

(56) References Cited

U.S. PATENT DOCUMENTS

| | | | | |
|---|---|---|---|---|
| 587,915 | A | 8/1897 | Beck | |
| 794,170 | A | 7/1905 | Fessler | |
| 1,038,729 | A | 9/1912 | Denes | |
| 1,398,871 | A | 11/1921 | Livingston | |
| 2,816,366 | A | 12/1957 | Barlow | |
| 2,842,860 | A | 7/1958 | Gray | |
| 3,137,947 | A | 6/1964 | Flower | |
| 3,583,823 | A | 6/1971 | Eaton | |
| 4,326,339 | A | 4/1982 | Marino | |
| 4,981,400 | A * | 1/1991 | Stover | 33/667 |
| 5,437,105 | A * | 8/1995 | Work | 33/644 |
| 6,158,137 | A | 12/2000 | Bramlett | |
| 6,895,684 | B1 * | 5/2005 | Firth | 33/613 |
| 7,155,840 | B1 * | 1/2007 | Carbonaro | 33/613 |
| 2007/0119067 | A1 * | 5/2007 | Mackey | 33/613 |

* cited by examiner

*Primary Examiner*—Yaritza Guadalupe-McCall
(74) *Attorney, Agent, or Firm*—Palomar Patent; Calif Tervo

(57) ABSTRACT

A positioner for positioning a partition or a divider at a predetermined position in a cabinet, such as for mounting a pair of drawers. The cabinet includes left and right side walls. A partition holder mounted on a frame holds the partition parallel to the left and right side walls. A left slider, slidingly mounted to the frame, includes a left jaw, and a right slider, slidingly mounted to the frame, includes a right jaw. The sliders are coupled such that longitudinal sliding movement of either slider moves the other slider an equal and opposite distance and such that positioning the left jaw to abut and align with the left side wall and positioning the right jaw to abut and align with the right side wall positions the partition holder at a predetermined holding position between the left and right side walls.

20 Claims, 2 Drawing Sheets

CABINET PARTITION POSITIONER

FIELD OF THE INVENTION

This invention relates in general to carpentry fixtures, and more particularly involves a device for positioning a partition or divider at a predetermined location between side walls of a cabinet.

BACKGROUND OF THE INVENTION

Cabinets, such as kitchen cabinets, are often constructed with a framework supporting side walls. The lower portion of the cabinet is generally open between the side walls and is made accessible by doors. The upper section of the cabinet is typically allotted to drawers and is sectioned by installing a partition or divider to the framework centrally of the side walls. Then mounting hardware, such as drawer sliders, is mounted to the partition and side wall for receiving the drawers. Commonly, the partition is mounted in the center such that the drawers are of equal width, but it is sometimes mounted to one side such that one drawer is larger than the other.

Conventionally, installation of the partition is very time consuming and there is much room for error. This is because the partition must be installed parallel to both side walls. Therefore, the partition must be the proper distance from each wall and must be vertical along its entire length. This involves multiple measurements, math, and markings and then holding the partition aligned with the marking and vertical while fastening it in place.

Therefore, there has been a need for a device to aid in the fast and accurate positioning of a partition in a cabinet.

SUMMARY OF THE INVENTION

Figures 1, 4:
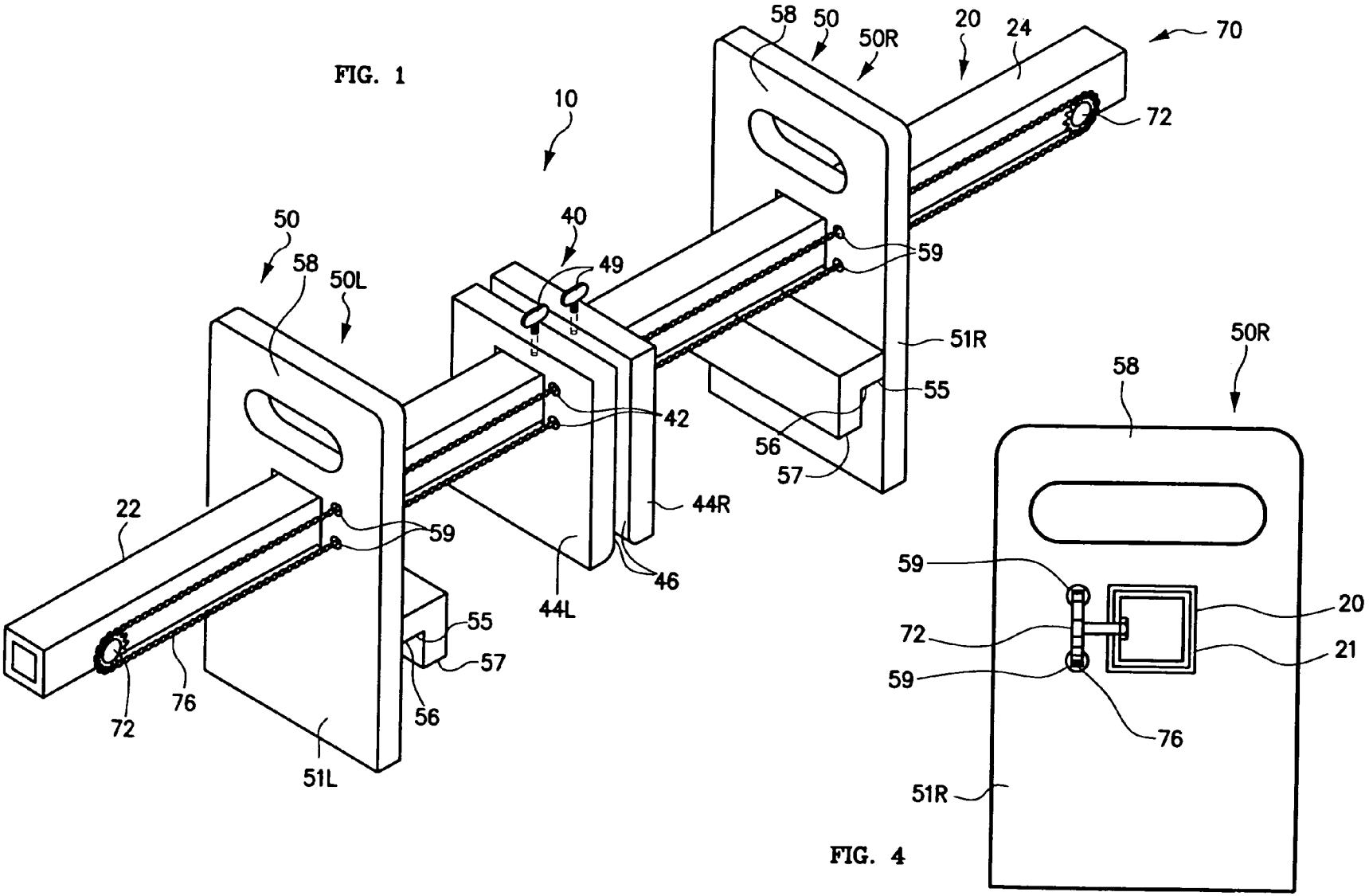
FIG. 1 is a top, front, left perspective view of an exemplary embodiment of the cabinet partition positioner of the invention.
FIG. 4 is a right side elevation view of the positioner taken on line 4-4 of FIG. 2.

This invention is a positioner for positioning a partition at a predetermined position in a cabinet such as for installing a pair of drawers. The cabinet includes a left side wall having an inner face and an outer face, a right side wall having an inner face and an outer face, and framework positioning the right side wall in spaced, parallel relationship to the left side wall.

The positioner includes a rigid frame having a left end, a right end, and a longitudinal axis. A partition holder mounted on the frame holds the partition parallel to the left and right side walls at a position defining a holding position on the frame. A left slider, slidingly mounted to the frame, includes a left jaw, and a right slider, slidingly mounted to the frame, includes a right jaw. The sliders are coupled by means such as a left pulley mounted to the left end of the frame, a right pulley mounted to the right end of the frame, and an endless flexible tension member disposed around the pulleys so as to form a taut endless circuit having a first run and a second run with the left slider being attached to the first run and the right slider being attached to the second run such that longitudinal sliding movement of either slider moves the other slider an equal and opposite distance and such that positioning the left jaw to abut and align with the left side wall and positioning the right jaw to abut and align with the right side wall positions the partition holder at the predetermined holding position between the left side wall and the right side wall.

Preferably, the partition holder is adapted for holding partitions of various widths and is selectively horizontally positionable on the frame.

To aid in speedy and positive placement of the positioner, the left slider includes a downward face for supporting the left slider on top of the left side wall and an opposed retaining member for abutting the face of the left side wall opposite the face the left jaw abuts, and the right slider includes a downward face for supporting the right slider on top of the right side wall and an opposed retaining member for abutting the face of the right side wall opposite the face the right jaw abuts.

Other features and many attendant advantages of the invention will become more apparent upon a reading of the following detailed description together with the drawings wherein like reference numerals refer to like parts throughout.

DETAILED DESCRIPTION OF THE INVENTION

With reference now to the drawings, there is shown in FIG. 1 is a top, front, left perspective view of an exemplary embodiment of the cabinet partition positioner 10 of the invention. Positioner 10 generally comprises a frame 20; a partition holder 40; a pair of sliders 50, such as left and right sliders 50L, 50R, and coupling means 70, such as pulleys 72 and chain 76, for coupling sliders 50; all mounted on frame 20.

Figure 3:
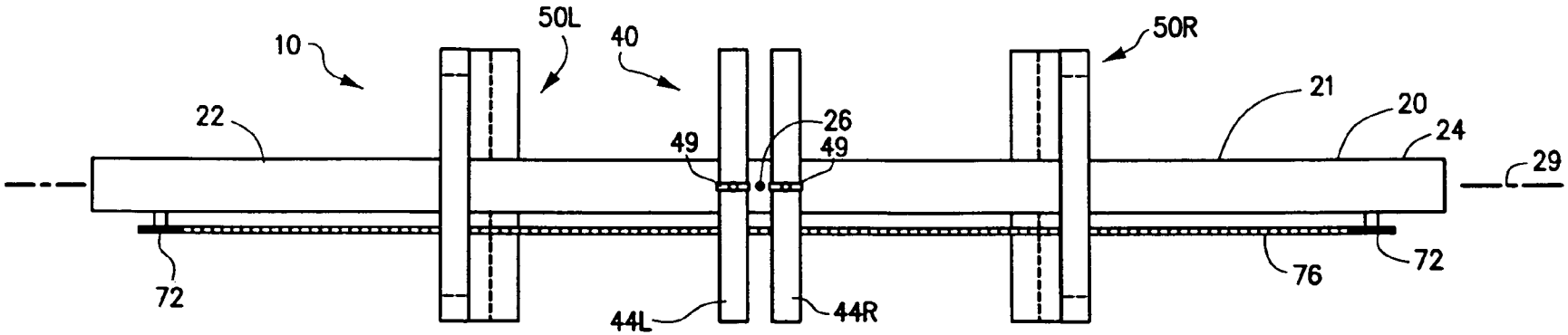
FIG. 3 is a top plan view of the positioner of FIG. 1.
Figure 2:
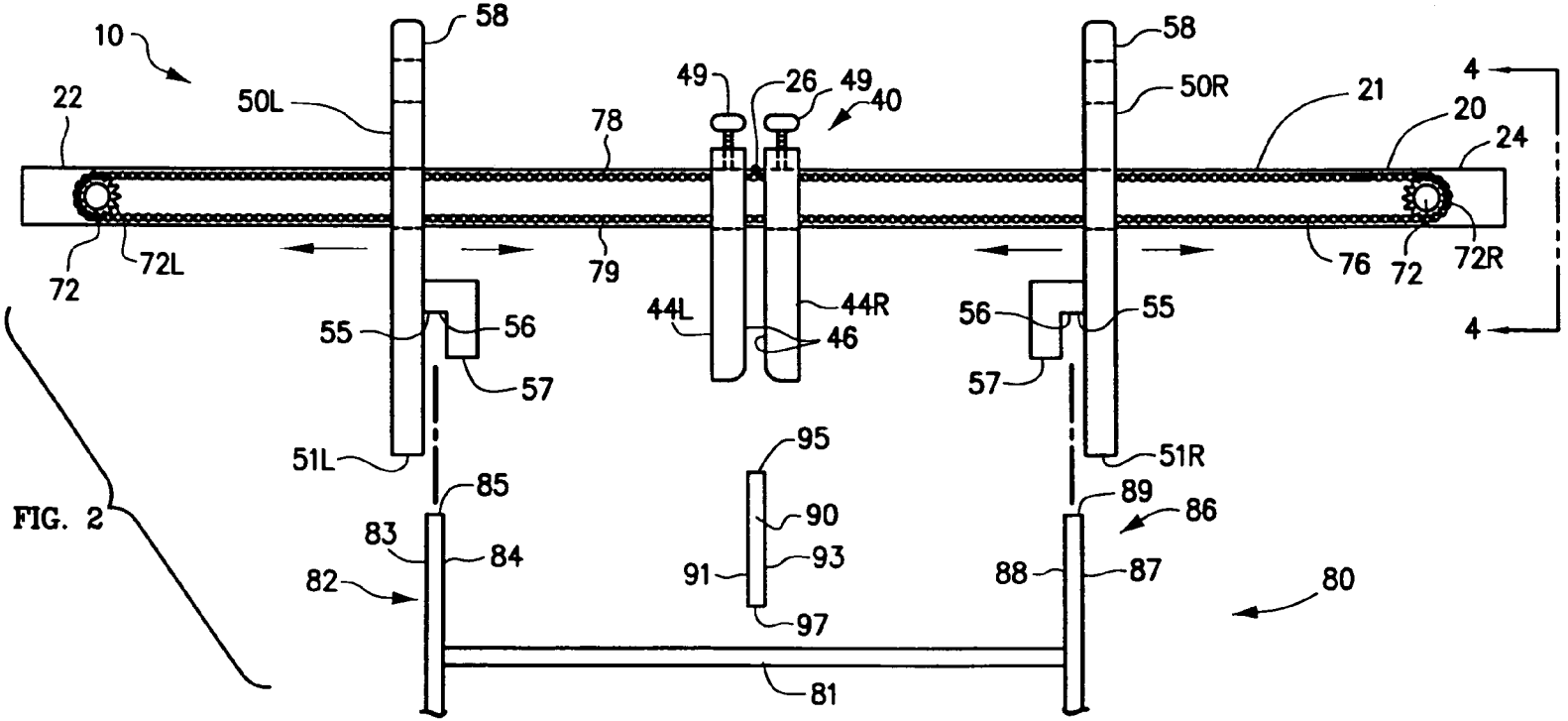
FIG. 2 is a front elevation view of the positioner of FIG. 1, a cabinet, and a partition.

FIG. 2 is a front elevation view of positioner 10 of FIG. 1, a cabinet 80, and a partition 90. FIG. 3 is a top plan view of positioner 10 of FIG. 1. FIG. 4 is a right side elevation view of positioner 10 taken on line 4-4 of FIG. 2.

Cabinet 80 includes a framework 81 joining a left side wall 82 and a right side wall 86. Framework 81 holds left side wall 82 and right side wall 86 in a spaced and parallel relationship. Left side wall 82 includes an outer face 83, and inner face 84, and a top side 85. Right side wall 86 includes an outer face 87, and inner face 88, and a top side 89. Partition 90 includes a left face 91, a right face 93, a top side 95, and a bottom side 97. Walls 82, 86 and partition 90 are typically elongate, planar, wood members, but could be made of other material common to the industry.

Positioner 10 is specifically designed for positioning partition 90 at a predetermined position in cabinet 80 wherein partition 90 is attached to cabinet 90, such as to framework 81. Cabinet 80 may be any cabinet that it is desirable to partition at a particular location. Positioner 10 is particularly suited for positioning partition 90 in cabinet 80 so as divide cabinet 80 into two parts for holding sliding drawers, in which case, hardware (not shown) for mounting the sliding drawers would be mounted on faces 91, 93 of partition 90 and on inner faces 84, 88 of walls 82, 86.

Positioner frame 20, such as rigid, elongate member 21 of the exemplary embodiment, has a left end 22, a right end 24, and a longitudinal axis 29. Frame 20 has a center position 26 midway between sliders 50. Frame 20 would typically be constructed of strong, rigid material, such as of metal or strong plastic.

Partition holder 40 is mounted on frame 20 and includes partition holding means, such as left and right arms 44L, 44R, each including a gripping portion 46 defining a plane, for holding partition 90 parallel to left and right side walls 82, 86 at a position defining a holding position on frame 20. Preferably, holder 40 is selectively horizontally positionable on frame 20 such that the holding position includes center position 26 and predetermined positions to the left and right thereof.

Preferably, holder 40 is adapted for holding partitions 90 of various widths. In the exemplary embodiment shown, holder 40 includes left and right arms 44L, 44R slidingly mounted on frame 20. Preferably each arm 44L, 44R includes position adjustment means, such as set screws 49, interacting with frame 20 for fixing each arm 44L, 44R at a desired longitudinal location on frame 20 and for adjusting the distance between gripping portions 46 so as to be able to hold partitions 90 of various widths. Although partition holder 40 is shown as two separate, individually positionable, sliding members; holder 40 may be a unitary sliding member with adjustable arms.

Left and right sliders 50L, 50R, are slidingly mounted to frame 20. Each slider 50 includes a handle 58 for holding by a user for positioning sliders 50. Left slider 50L includes a downward extending jaw 51L disposed to the left of the partition holding position for abutting and aligning with left side wall 82. Right slider 50R includes a downward extending jaw 51R disposed to the right of the partition holding position for abutting and aligning with right side wall 86.

Left and right sliders 50L, 50R, are coupled to one another by coupling means 70, such as using a taut, flexible tension member, such as chain 76 about pulleys 72, such that longitudinal sliding movement of either slider moves the other slider an equal and opposite distance. Left pulley 72L is mounted to left end 22 of frame 20 and right pulley 72R is mounted to right end 24 of frame 20. Chain 76 passes around pulleys 72L, 72R such that there is a first run, such as top run, 78 and a second run, such as bottom run 79. One of the sliders 50, such as right slider 50R is attached to top run 78 of chain 76 and the other, such as left slider 50L is attached to bottom run 79 of chain 76.

Many other flexible tension members, such as belts, lines or ropes, could be used instead of chain 76. Although chain 76 is shown disposed through bores 42 in partition holder 40 and bores 59 in sliders 50, it need not be so arranged. For example, partition holder 40 or sliders 50 may be shaped such that chain 76 passes outside of them.

Other coupling means 70, such as a rack and pinion or a jack screw with counter threaded portions, may be used. In a rack and pinion embodiment, the pinion is mounted in the frame and a pair of racks, each rack engaging an opposite side of the pinion, serves as sliders. In the jack screw embodiment, the jack screw is mounted in the frame and one slider is threadably mounted to one threaded portion and the other slider is mounted to the other (reverse) threaded portion.

Coupling means 70 couples sliders 50 such that longitudinal sliding movement of either slider 50 moves the other slider 50 an equal and opposite distance such that positioning left jaw 51L to abut and align with left side wall 82 and positioning right jaw 51R to abut and align with right side wall 86 positions partition holder 40 at the predetermined holding position for partition 90 between left side wall 82 and right side wall 86. Jaws 51L, 51R are centered about center position 26.

Each slider 50L, 50R includes means, such as horizontal platform 55 and opposed retaining member 57, for aiding in alignment of jaws 51. Each horizontal platform 55 is adapted, such as including a downward face 56, for supporting slider 50 on a top side 85, 89 of left or right side wall 82, 86. Slider 50L includes an opposed retaining member 57 for abutting the face of left side wall 82 opposite the face the left jaw 51L abuts such that slider 50L is retained on left side wall 82 while partition 90 is placed and attached. Slider 50R includes an opposed retaining member 57 for abutting the face of right side wall 86 opposite the face right jaw 51R abuts for retaining slider 50R on right side wall 86 while partition 90 is placed and attached.

To position partition 90 equidistant from side walls 82, 86, partition holder 40 is positioned to hold partition 90 at the center position 26. To position partition 90 at a non-centered position, holder 40 is moved longitudinally to either side of center position 26 to the desired placement position for partition 90.

From the foregoing description, it is seen that the present invention provides an extremely simple, efficient, and reliable device for positioning a partition in a cabinet.

Although a particular embodiment of the invention has been illustrated and described, various changes may be made in the form, composition, construction, and arrangement of the parts herein without sacrificing any of its advantages. Therefore, it is to be understood that all matter herein is to be interpreted as illustrative and not in any limiting sense, and it is intended to cover in the appended claims such modifications as come within the true spirit and scope of the invention.

We claim:

1. A positioner for positioning a partition at a predetermined position in a cabinet; the cabinet including: a framework, a left side wall; and a right side wall; the framework positioning the right side wall in spaced, parallel relationship to the left side wall; the positioner including:

a rigid frame having a left end, a right end, and a longitudinal axis, a partition holder mounted on said frame including:

holding means for holding the partition parallel to the left and right side walls at a position defining a holding position on said frame;

a left slider slidingly mounted to said frame and including:

a left jaw disposed to the left of said holding position;

a right slider slidingly mounted to said frame and including:

a right jaw disposed to the right of said holding position; and coupling means coupling said left slider and said right slider such that longitudinal sliding movement of either slider moves the other slider an equal and opposite distance and such that positioning said left jaw to abut and align with the left side wall and positioning said right jaw to abut and align with the right side wall positions said partition holder at a predetermined holding position between the left side wall and the right side wall.

2. The positioner of claim 1 wherein:

said partition holder is adapted for holding partitions of various widths.

3. The positioner of claim 1 wherein:

said partition holder is selectively horizontally positionable on said frame.

4. The positioner of claim 1 wherein:

said partition holder includes:

left and right arms; each arm including a gripping portion for holding the partition parallel to the left and right side walls.

5. The positioner of claim 4 wherein:

said left and right arms are each independently selectively positionable on said frame.

6. The positioner of claim 1 wherein:

said left slider includes a downward face for supporting said left slider on top of the left side wall; and said right slider includes a downward face for supporting said right slider on top of the right side wall.

7. The positioner of claim 6 wherein the left side wall includes an inner face and an outer face, the right side wall includes and inner face and an outer face, and:

said left slider includes an opposed retaining member for abutting the face of the left side wall opposite the face said left jaw abuts; and said right slider includes an opposed retaining member for abutting the face of the right side wall opposite the face said right jaw abuts.

8. The positioner of claim 7 wherein:

said partition holder is selectively horizontally positionable on said frame.

9. The positioner of claim 1 wherein the left side wall includes an inner face and an outer face and:

said left slider includes an opposed retaining member for abutting the face of the left side wall opposite the face said left jaw abuts.

10. The positioner of claim 1 wherein the left side wall includes an inner face and an outer face, the right side wall includes and inner face and an outer face, and:

said left slider includes an opposed retaining member for abutting the face of the left side wall opposite the face said left jaw abuts; and said right slider includes an opposed retaining member for abutting the face of the right side wall opposite the face said right jaw abuts.

11. The positioner of claim 1 wherein:

said partition holder includes:

left and right arms; each arm including a gripping portion for holding the partition parallel to the left and right side walls.

12. The positioner of claim 11 wherein:

said left and right arms are each independently selectively positionable on said frame.

13. The positioner of claim 1 wherein:

said left slider includes a downward face for supporting said left slider on top of the left side wall; and said right slider includes a downward face for supporting said right slider on top of the right side wall.

14. The positioner of claim 13 wherein the left side wall includes an inner face and an outer face, the right side wall includes and inner face and an outer face, and:

said left slider includes an opposed retaining member for abutting the face of the left side wall opposite the face said left jaw abuts; and said right slider includes an opposed retaining member for abutting the face of the right side wall opposite the face said right jaw abuts.

15. The positioner of claim 14 wherein:

said partition holder is selectively horizontally positionable on said frame.

16. The positioner of claim 1 wherein the left side wall includes an inner face and an outer face and:

said left slider includes an opposed retaining member for abutting the face of the left side wall opposite the face said left jaw abuts.

17. The positioner of claim 1 wherein the left side wall includes an inner face and an outer face, the right side wall includes and inner face and an outer face, and:

said left slider includes an opposed retaining member for abutting the face of the left side wall opposite the face said left jaw abuts; and said right slider includes an opposed retaining member for abutting the face of the right side wall opposite the face said right jaw abuts.

18. A positioner for positioning a partition at a predetermined position in a cabinet; the cabinet including: a framework, a left side wall; and a right side wall; the framework positioning the right side wall in spaced, parallel relationship to the left side wall; the positioner including:

a rigid frame having a left end, a right end, and a longitudinal axis, a partition holder mounted on said frame including:

holding means for holding the partition parallel to the left and right side walls at a position defining a holding position on said frame;

a left slider slidingly mounted to said frame and including:

a left jaw disposed to the left of said holding position;

a right slider slidingly mounted to said frame and including:

a right jaw disposed to the right of said holding position; and coupling means coupling said left slider and said right slider including:

a left pulley mounted to said left end of said frame;

a right pulley mounted to said right end of said frame; and an endless flexible tension member disposed around said pulleys so as to form a taut endless circuit having a first run and a second run; said left slider being attached to said first run; said right slider being attached to said second run such that longitudinal sliding movement of either slider moves the other slider an equal and opposite distance and such that positioning said left jaw to abut and align with the left side wall and positioning said right jaw to abut and align with the right side wall positions said partition holder at a predetermined holding position between the left side wall and the right side wall.

19. The positioner of claim 1 wherein:

said partition holder is adapted for holding partitions of various widths.

20. The positioner of claim 1 wherein:

said partition holder is selectively horizontally positionable on said frame.

* * * * *

UNITED STATES PATENT AND TRADEMARK OFFICE

CERTIFICATE OF CORRECTION

PATENT NO. : 7,421,797 B1
APPLICATION NO. : 11/985520
DATED : September 9, 2008
INVENTOR(S) : Servin et al.

It is certified that error appears in the above-identified patent and that said Letters Patent is hereby corrected as shown below:

In claim 11, line 1, change “1” to “18”.
In claim 13, line 1, change “1” to “18”.
In claim 16, line 1, change “1” to “18”.
In claim 17, line 1, change “1” to “18”.
In claim 19, line 1, change “1” to “18”.
In claim 20, line 1, change “1” to “18”.

Signed and Sealed this

Twenty-fifth Day of November, 2008

JON W. DUDAS
*Director of the United States Patent and Trademark Office*

UNITED STATES PATENT AND TRADEMARK OFFICE

CERTIFICATE OF CORRECTION

PATENT NO. : 7,421,797 B1
APPLICATION NO. : 11/985520
DATED : September 9, 2008
INVENTOR(S) : Servin et al.

It is certified that error appears in the above-identified patent and that said Letters Patent is hereby corrected as shown below:

Column 5, In claim 11, line 27, change “1” to “18”.
Column 5, In claim 13, line 35, change “1” to “18”.
Column 5, In claim 16, line 52, change “1” to “18”.
Column 6, In claim 17, line 4, change “1” to “18”.
Column 6, In claim 19, line 47, change “1” to “18”.
Column 6, In claim 20, line 50, change “1” to “18”.

This certificate supersedes the Certificate of Correction issued November 25, 2008.

Signed and Sealed this

Twenty-third Day of December, 2008

JON W. DUDAS
*Director of the United States Patent and Trademark Office*